US008992746B2

(12) United States Patent
Miyaji et al.

(10) Patent No.: US 8,992,746 B2
(45) Date of Patent: Mar. 31, 2015

(54) ANODIZING APPARATUS

(75) Inventors: Yasuyoshi Miyaji, Kyoto (JP); Noriyuki Hayashi, Kyoto (JP); Takamitsu Inahara, Kyoto (JP); Takao Yonehara, Sunnyvale, CA (US); Karl-Josef Kramer, San Jose, CA (US); Subramanian Tamilmani, Milpitas, CA (US)

(73) Assignees: Dainippon Screen Mfg. Co., Ltd. (JP); Solexel, Inc., Milpitas, CA (US)

( * ) Notice: Subject to any disclaimer, the term of this patent is extended or adjusted under 35 U.S.C. 154(b) by 395 days.

(21) Appl. No.: 13/310,083

(22) Filed: Dec. 2, 2011

(65) Prior Publication Data

US 2012/0138455 A1 Jun. 7, 2012

(30) Foreign Application Priority Data

Dec. 2, 2010 (JP) ..... 2010-269416
Dec. 2, 2010 (JP) ..... 2010-269417

(51) Int. Cl.

| | |
|---|---|
| ***C25B 9/00*** | (2006.01) |
| ***C25B 9/02*** | (2006.01) |
| ***C25B 9/18*** | (2006.01) |
| ***C25C 7/00*** | (2006.01) |
| ***C25C 7/06*** | (2006.01) |

(Continued)

(52) U.S. Cl.

CPC ..... *C25D 11/005* (2013.01); *Y10S 414/135* (2013.01); *Y10S 414/136* (2013.01); *Y10S 414/137* (2013.01); *Y10S 414/138* (2013.01); *Y10S 414/139* (2013.01); *Y10S 414/14* (2013.01); *Y10S 414/141* (2013.01)

USPC ..... 204/252; 204/198; 204/297.06; 205/157; 414/935; 414/936; 414/937; 414/938; 414/939; 414/940; 414/941

(58) Field of Classification Search

CPC ..... C25B 9/00; C25B 9/02; C25B 9/18; C25C 7/00; C25C 7/02; C25C 7/06; C25C 3/10

USPC ..... 204/256, 258, 270, 285, 297.01, 204/298.15, 198, 297.06; 205/157; 414/935–941

See application file for complete search history.

(56) References Cited

U.S. PATENT DOCUMENTS 5,458,755 A 10/1995 Fujiyama et al.
5,854,123 A 12/1998 Sato et al.

(Continued)

FOREIGN PATENT DOCUMENTS

JP 5-198556 8/1993
JP 6-275598 9/1994

(Continued)

*Primary Examiner* — Zulmariam Mendez
(74) *Attorney, Agent, or Firm* — Ostrolenk Faber LLP

(57) ABSTRACT

An apparatus for anodizing substrates immersed in an electrolyte solution. A substrate holder mounted in a storage tank includes a first support unit having first support elements for supporting, in a liquid-tight condition, only lower circumferential portions of the substrates, and a second support unit attachable to and detachable from the first support unit and having second support elements for supporting, in a liquid-tight condition, remaining circumferential portions of the substrates. A drive mechanism separates the first support unit and the second support unit when loading and unloading the substrates, and for connecting the first support unit and the second support unit after the substrates are placed in the substrate holder.

19 Claims, 15 Drawing Sheets

(51) Int. Cl.
*C25C 3/10* (2006.01)
*C25D 11/00* (2006.01)

(56) References Cited

U.S. PATENT DOCUMENTS

| | | | | |
|---|---|---|---|---|
| 6,258,244 | B1 | 7/2001 | Ohmi et al. | |
| 2004/0256238 | A1 * | 12/2004 | Suzuki et al. | 205/118 |
| 2005/0092600 | A1 * | 5/2005 | Yoshioka et al. | 204/198 |
| 2007/0187257 | A1 * | 8/2007 | Noji et al. | 205/640 |
| 2013/0020206 | A1 * | 1/2013 | Wuebben et al. | 205/618 |

FOREIGN PATENT DOCUMENTS

| | | | | |
|---|---|---|---|---|
| JP | 10-302257 | * 11/1998 | | G11B 5/85 |
| JP | 2003-45869 | 2/2003 | | |

* cited by examiner

ANODIZING APPARATUS

BACKGROUND OF THE INVENTION (1) Field of the Invention

This invention relates to an anodizing apparatus for carrying out electrolytic etching treatment on various substrates, such as semiconductor wafers, substrates for liquid crystal displays, substrates for plasma displays, substrates for organic EL devices, substrates for FEDs (Field Emission Displays), optical disk substrates, substrates for magnetic disks, substrates for magnetic optical disks, substrates for photomasks, substrates for solar cells, and substrates for micro-electro-mechanical systems (MEMS). More particularly, the invention relates to a batch processing technique for treating a plurality of substrates at the same time with high throughput.

(2) Description of the Related Art

Conventionally, an apparatus (first apparatus) of this type includes a fluororesin forming tank (2), a pair of platinum electrodes (3*a*, 3*b*), and a substrate support jig (4) for holding a substrate (1) (see Japanese Unexamined Patent Publication H5-198556 (FIGS. 1 and 2), for example).

The fluororesin forming tank (2) stores an electrolytic solution (6*a*, 6*b*). The pair of platinum electrodes (3*a*, 3*b*) are arranged, as spaced from each other, inside the fluororesin forming tank (2). The substrate support jig (4) has an opening substantially corresponding to the outside diameter of the substrate (1), and has a cutout spreadable for inserting the substrate (1) into the substrate support jig (4). The jig (4) holds the substrate (1) through a seal (5*a*) to be liquid-tight with respect to the electrolytic solution (6*a*, 6*b*). The substrate support jig (4) is immersed along with the substrate (1) in the electrolytic solution (6*a*, 6*b*) in the fluororesin forming tank (2). When the pair of platinum electrodes (3*a*, 3*b*) are electrified, a chemical reaction starts to render the substrate (1) porous through the opening.

Another apparatus (second apparatus) of this type includes an electrolytic solution tank (11), a pair of electrodes (14A, 14B), and a substrate support member (15) for holding a substrate (S) (see Japanese Unexamined Patent Publication No. 2003-45869 (FIGS. 1 and 3), for example).

The electrolytic solution tank (11) stores an electrolytic solution. The pair of electrodes (14A, 14B) are attached to opposite inner walls of the electrolytic solution tank (11). The substrate support member (15) has a first cassette (21) and a second cassette (22) for pinching the substrate (S) in between. The first cassette (21) has an opening (21A) substantially corresponding to the diameter of the substrate (S), and the second cassette (22) has a similar opening (22A). The first cassette (21) and second cassette (22) of the substrate support member (15) hold the substrate (S) in between, and engage the substrate (S) by pressing on peripheries of the substrate (S). The substrate support member (15) is inserted in a guide groove (16) of the electrolytic solution tank (11), the pair of electrodes (14A, 14B) are electrified, thereby causing a chemical reaction to render the substrate (S) porous through the openings (21A, 22A).

A further apparatus (third apparatus) of this type includes a lower tank portion (103), an upper tank portion (104), an anode plate (101), a silicon wafer (106), and a cathode plate (102) (see Japanese Unexamined Patent Publication H6-275598 (FIG. 1), for example).

The lower tank portion (103) and upper tank portion (104) store an electrolytic solution, and a wafer (105) under treatment is placed therebetween. The silicon wafer (106) is disposed to contact the anode plate (101) electrically, and not to contact the electrolytic solution in the lower tank portion (103). When the anode plate (101) and cathode plate (102) are electrified, a chemical reaction takes place to render the wafer (105) porous.

Since, in the third apparatus, the silicon wafer (106) keeps the anode plate (101) out of contact with the electrolytic solution, the metal of the electrode (101) does not elute in the electrolytic solution. This prevents metal contamination of the wafer (105).

However, the conventional examples with such constructions have the following problems.

In the first conventional apparatus, in order to make the substrate support jig (4) support the substrate (1), it is necessary to insert the substrate (1) in the opening after spreading the cutout of the substrate support jig (4). It is therefore difficult to make the substrate support jig (4) support the substrate (1) automatically by means of a mechanical device. When the apparatus is applied to batch processing for treating a plurality of substrates (1) at the same time, it becomes more difficult to automate the treatment in an effective way.

In the second conventional apparatus, in order to make the substrate support member (15) hold the substrate (S), it is necessary to place the substrate (S) to be pinched between the first cassette (21) and second cassette (22). Therefore, as with the first apparatus, there is a problem of being incapable of automating the treating process. Although the publication discloses an embodiment for treating two substrates (S), since the substrate support member (15) is constructed to have a considerable thickness, the apparatus is unsuitable for batch processing for treating an increased number of substrates (S).

The third conventional apparatus has the same problem as the first apparatus. In addition, since the silicon wafer (106) is made porous by the chemical reaction, it will be necessary to change the silicon wafer (106) frequently. Therefore, this apparatus has an additional problem of consuming time in maintenance to lower its operating rate.

SUMMARY OF THE INVENTION

This invention has been made having regard to the state of the art noted above, and its object is to provide an anodizing apparatus well suited for automation and batch processing, which is achieved by devising a mechanism for holding substrates.

Another object of this invention is to provide an anodizing apparatus which is capable of batch processing and of holding down the frequency of changing electrodes to improve the operating rate.

The above object is fulfilled, according to this invention, by an anodizing apparatus for causing an anodizing reaction on substrates immersed in an electrolyte solution, comprising a storage tank for storing the electrolyte solution; a substrate holder mounted in the storage tank, and including a first support unit having a plurality of first support elements arranged in a direction of arrangement of the substrates for contacting and supporting, in a liquid-tight condition, only lower portions of circumferential surfaces of the substrates, and a second support unit attachable to and detachable from the first support unit and having a plurality of second support elements arranged in the direction of arrangement of the substrates for contacting and supporting, in a liquid-tight condition, remaining portions of the circumferential surfaces of the substrates other than the lower portions supported by the first support elements; and a drive mechanism for separating the first support unit and the second support unit when placing the plurality of substrates in the substrate holder and when unloading the plurality of substrates from the substrate holder, and for connecting the first support unit and the second support unit after the plurality of substrates are placed in the substrate holder.

According to this invention, the drive mechanism separates the first support unit and second support unit of the substrate holder arranged in the storage tank. In this state, a plurality of substrates are respectively placed between the first support elements of the first support unit, whereby only lower portions of the circumferential surfaces of the substrates are supported in a liquid-tight condition relative to the electrolyte solution. When the second support unit is connected to the first support unit by the drive mechanism, the plurality of substrates are supported by the second support elements, with the remaining portions of the circumferential surfaces of the substrates put in a liquid-tight condition relative to the electrolyte solution. Consequently, the entire circumferential surfaces of the substrates are now in the liquid-tight condition relative to the electrolyte solution. After the anodizing reaction is completed, the second support unit is separated from the first support unit by the drive mechanism, and the plurality of substrates supported by the first support unit are unloaded therefrom. Thus, the first support unit and second support unit of the substrate holder being attachable to and detachable from each other by the drive mechanism enables a plurality of substrates to be mechanically loaded into and unloaded from the storage tank. As a result, the anodizing apparatus provided is well suited for automation and batch treatment.

In this invention, the substrate holder may assume a cylindrical appearance when the first support unit and the second support unit are connected, and include ion-exchange membranes disposed at one end and the other end thereof in the direction of arrangement of the substrates for permitting passage of ions and blocking passage of part of the electrolyte solution in the substrate holder and part of the electrolyte solution in the storage tank.

When the first support unit and second support unit of the substrate holder are connected, the electrolyte solution in the storage tank and the electrolyte solution in the substrate holder are separate from each other. This assures a constant concentration of the electrolyte solution around the substrates during the anodizing reaction. Therefore, the plurality of substrates treated at the same time can undergo a uniform anodizing reaction. When replacing the plurality of substrates with a new plurality of substrates, the first support unit and second support unit are separated from each other. This results in an interchange between the electrolyte solution in the substrate holder and the electrolyte solution in the storage tank, whereby the concentration of the electrolyte solution is made equal for the different lots. Therefore, the treatment can be uniformed between the lots.

In this invention, the second support unit may include a left second support unit having left second support elements as the second support elements for supporting left sides of the remaining portions of the circumferential surfaces of the substrates, and a right second support unit having right second support elements as the second support elements for supporting right sides of the remaining portions of the circumferential surfaces of the substrates.

Since the second support unit is divided into the left second support unit and right second support unit which, when separated from the first support unit, can easily open up areas above the plurality of substrates supported by the first support unit. This allows a transport mechanism to move easily to and from the substrate holder for transferring the plurality of substrates.

In this invention, the first support elements may support lower portions of the circumferential surfaces which correspond to chords shorter than diameters of the substrates.

This allows the transport mechanism for transferring the substrates to and from the substrate holder to hold the substrates at portions below maximum diameter portions thereof. Thus, the transport mechanism can hold the substrates reliably without applying stress to the substrates.

In this invention, the left second support unit and the right second support unit may have fulcrums, respectively, located in positions at a bottom of the storage tank and having the first support unit in between, and may be rockable away from each other when separating from the first support unit.

The left second support unit and right second support unit, when rocking about the respective fulcrums to connect to the first support unit, will apply forces from the circumferential surfaces of the substrates toward the centers of the substrates. Thus, the left second support unit and right second support unit can support the circumferential surfaces of the substrates in a liquid-tight condition without applying excessive stress to the substrates. When separated, the left second support unit and right second support unit will move to positions to have the inner surfaces thereof turned upward. In such positions, bubbles generating from the chemical reaction can be released, thereby to prevent treating unevenness due to the bubbles from occurring to succeeding lots.

In this invention, the apparatus may further comprise a pair of covers for opening and closing an upper opening of the storage tank, wherein the drive mechanism is used also as a cover drive mechanism for driving the pair of covers in opening and closing operations.

The drive mechanism used also as the cover drive mechanism for driving the pair of covers can simplify the construction and facilitate control of various components at times of transporting the substrates. When the covers are closed by the cover drive mechanism, the substrate holder can support the entire circumferential surfaces of the substrates in the liquid-tight condition with increased reliability. When the covers are opened, the upper portions of the substrate holder are also opened. This can shorten the time taken in transporting the substrates into and out of the treating tank while maintaining the uniform treatment of the substrates.

In this invention, the second support elements may have exhaust passages extending from inner surfaces to outer surfaces thereof, with upper openings thereof located above a solution level in the storage tank.

Gas generated by the anodizing reaction and stagnating as bubbles in the substrate holder could cause reaction unevenness. However, the exhaust passages are provided to discharge the generated gas, instead of allowing the gas to stagnate in the substrate holder. This construction can prevent the treating unevenness due to the bubbles.

In this invention, the first support elements may have an elastic member applied to inner surfaces thereof, and grooves formed in positions where lower surfaces of the substrates are placed.

When the substrates are placed on the first support elements and the upper circumferential surfaces of the substrates are supported by the second support elements, the lower circumferential surfaces of the substrates will press the elastic member and enter the grooves. Therefore, part of the front and rear surfaces of each substrate including the circumferential surface thereof can be supported, whereby the electrolyte solution does not circulate between adjoining substrates. As a result, the concentration of the electrolyte solution acting on the substrates remains stable, to realize stable treatment.

In this invention, the first support elements may have guide pins arranged at opposite sides of each groove for guiding the substrates being placed and preventing turnover of the substrates.

The substrates, when being placed on the first support elements, can be guided reliably to predetermined positions. The substrates, just as placed, can be prevented from turning over.

In this invention, each of the guide pins may have a base projecting from the elastic member, and a guide portion formed on an upper part of the base and projecting from the base toward one of the substrates.

The guide portion, while serving to guide the substrate and stabilize its position, permits the electrolyte solution to remain between the base and a substrate surface. This construction can lessen locations around the guide portion where the chemical reaction does not take place.

In this invention, a junction between the left second support unit and the right second support unit may have a notch pressing mechanism for pressing notches of the substrates through elastic members provided on inner surfaces of the left second support unit and the right second support unit.

The notch pressing mechanism presses the elastic members into the notches of the substrates. This can prevent the electrolyte solution on the front and back surface sides of the substrates from circulating through the notches, which could otherwise cause concentration fluctuations.

In this invention, the notch pressing mechanism may include a slide member provided on one of the left second support unit and the right second support unit to be slidable toward centers of the substrates, and a pressing member provided on the other of the left second support unit and the right second support unit for pressing the slide member when the left second support unit and the right second support unit join each other.

When the left second support unit and the right second support unit join each other, the slide member is pressed by the pressing member, whereby the notches of the substrates are pressed by the elastic member. Since the notch pressing mechanism is operable as interlocked to the operation for joining the left second support unit and the right second support unit, it is not necessary to carry out special control.

In this invention, an elastic member provided on inner surfaces of the first support elements may be harder than an elastic member provided on inner surfaces of the second support elements.

When the substrates are supported by the second support elements, the positions of the substrates can be prevented from shifting excessively to the first support elements. Therefore, the lower circumferential surfaces and the remaining circumferential surfaces of the substrates can be supported substantially uniformly.

In this invention, the apparatus may further comprise foamed materials provided for a junction between the left second support unit and the first support unit, and for a junction between the right second support unit and the first support unit.

The foamed materials can lessen a shock occurring at a time of connection, and promote a sealed state at the junctions.

In another aspect of the invention, an anodizing apparatus for causing an anodizing reaction on substrates immersed in an electrolyte solution, comprises a storage tank for storing an electrolyte solution of a first concentration; a substrate holder mounted in the storage tank for holding a plurality of substrates, with entire circumferential surfaces of the substrates in a liquid-tight condition relative to the electrolyte solution of the first concentration; a pair of electrode tanks arranged adjacent the storage tank for storing an electrolyte solution of a second concentration lower than the first concentration; electrodes arranged in the pair of electrode tanks, respectively; and ion-exchange membranes provided between the storage tank and the pair of electrode tanks for permitting movement of ions between the electrolyte solution in the storage tank and the electrolyte solution in the pair of electrode tanks.

According to this invention, a plurality of substrates are held by the substrate holder mounted in the storage tank, and the electrodes arranged in the pair of electrode tanks are electrified. Then, ions move between the pair of electrode tanks, which cause a chemical reaction on the plurality of substrates through the ion-exchange membranes. This enables batch treatment for treating a plurality of substrates at a time. The second concentration of the electrolyte solution stored in the electrode tanks is set lower than the first concentration of the electrolyte solution stored in the storage tank and contacting the substrates. Since the chemical reaction is inhibited in the electrode tanks compared with that in the storage tank, a local chemical reaction occurring to each of the electrodes in the electrode tanks can be inhibited. As a result, degradation of the electrodes can be inhibited, contamination of the substrates can be prevented, and the operating rate of the apparatus can be improved.

In this invention, the substrate holder may assume a cylindrical appearance, and include through-bores disposed at one end and the other end thereof in a direction of arrangement of the substrates, the through-bores being aligned to the electrodes.

Since the electric field between the electrodes is directed to the plurality of substrates via the through-bores, a chemical reaction is produced efficiently.

In this invention, each of the electrodes may have a first electrode member electrically connected to a power source and maintained out of contact with the electrolyte solution, and a second electrode member electrically connected to the first electrode member and maintained in contact with the electrolyte solution.

The first electrode member maintained out of contact with the electrolyte solution is safe against deterioration.

In this invention, the second electrode member may be homogeneous to the substrates treated in the substrate holder.

The materials forming the second electrode member are eluted into the electrolyte solution. However, since the second electrode member is homogenous to the substrates under treatment, the substrates under treatment are prevented from being contaminated by a heterogeneous substance.

In this invention, the apparatus may further comprise partitions disposed between the storage tank and the pair of electrode tanks, and having openings, respectively, the ion-exchange membranes being provided in the openings.

This construction can permit ions to move between the pair of electrode tanks through the ion-exchange membranes provided in the openings.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

FIG. 4 includes views showing a substrate holder, in which

FIG. 6 includes views showing the first support unit, in which

FIG. 7 includes views showing a second support unit, in which

FIG. 8 includes schematic views showing operation at a time of connecting the first support unit and second support unit, in which

FIG. 9 includes schematic views showing operation at a time of connecting the left second support unit and right second support unit, in which

FIG. 10 includes schematic views showing states of a substrate placed on the first support unit, in which

FIG. 12 includes views showing a modification of the first support unit, in which

DESCRIPTION OF THE PREFERRED EMBODIMENTS

A preferred embodiment of this invention will be described in detail hereinafter with reference to the drawings.

Figure 1:
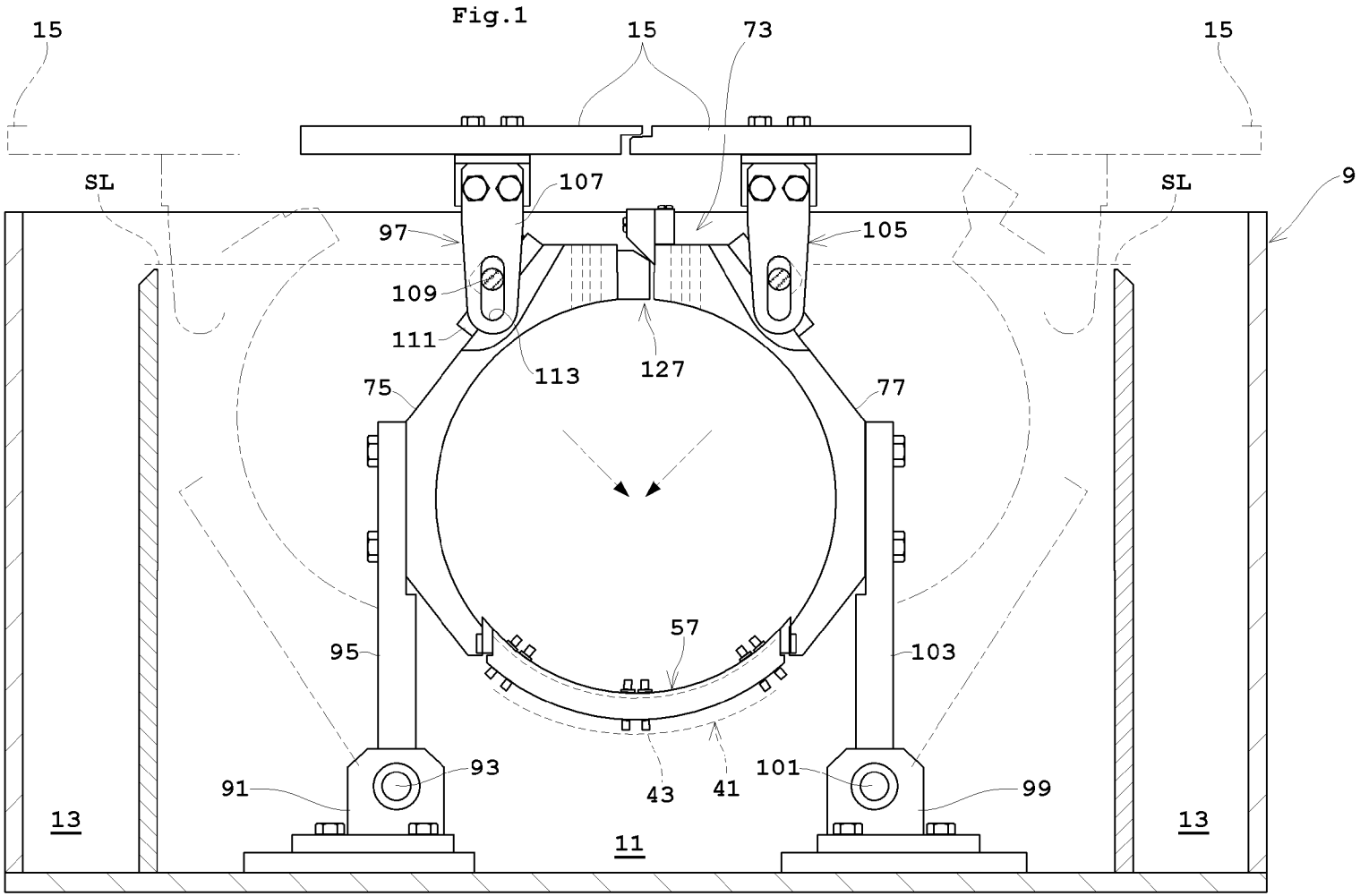
FIG. 1 is a front view in vertical section of an outline construction of an anodizing apparatus according to this invention.
Figure 2:
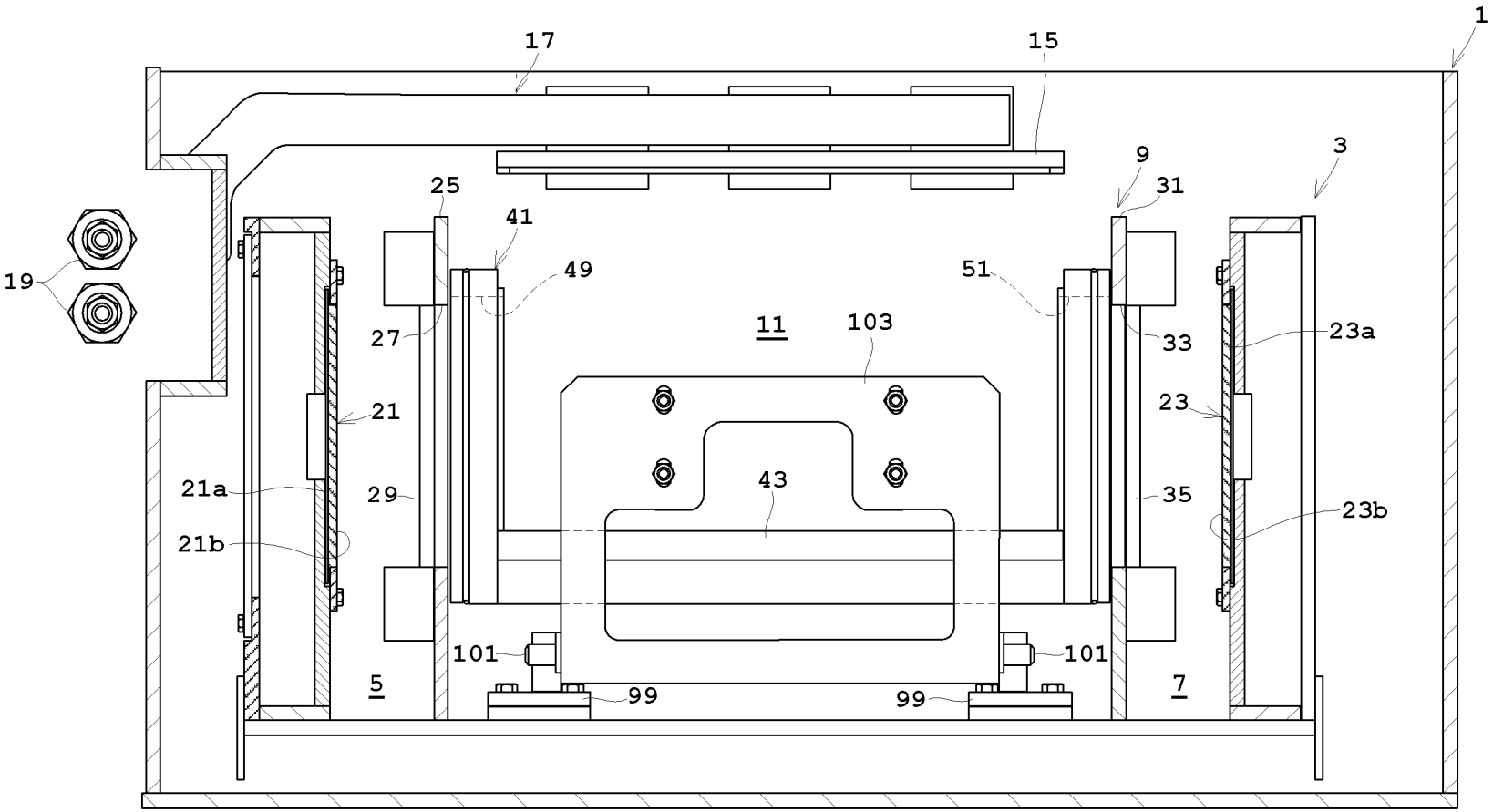
FIG. 2 is a side view in vertical section of at the outline construction of the anodizing apparatus.
Figure 3:
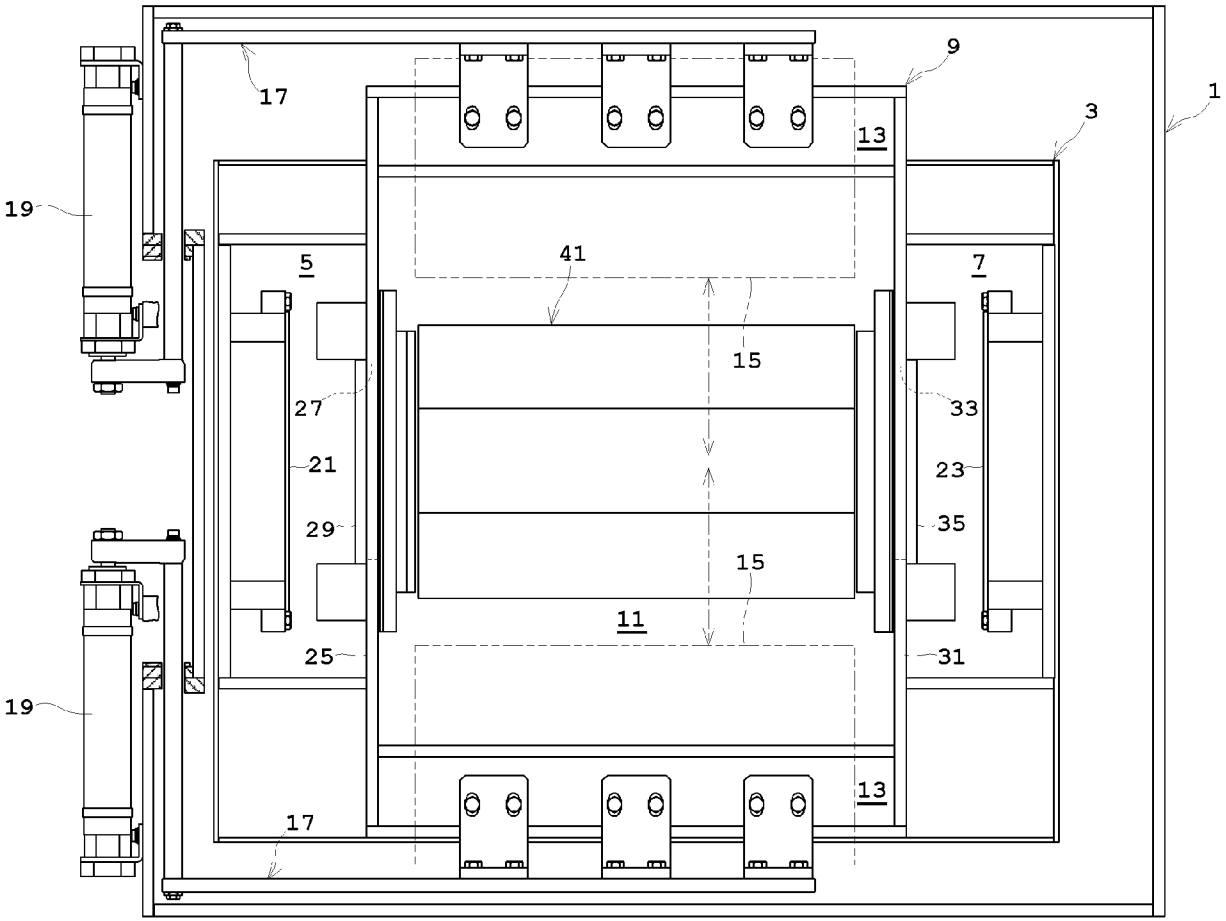
FIG. 3 is a plan view of the outline construction of the anodizing apparatus.

FIG. 1 is a front view in vertical section of an outline construction of an anodizing apparatus according to this invention. FIG. 2 is a side view in vertical section of the outline construction of the anodizing apparatus. FIG. 3 is a plan view of the outline construction of the anodizing apparatus.

The anodizing apparatus in this embodiment has a function for causing an anodizing reaction on a plurality of silicon substrates at the same time, thereby to treat the substrates to be porous, for example. This anodizing apparatus includes an outer receptacle 1 and an inner receptacle 3. The inner receptacle 3 is disposed inside the outer receptacle 1. For convenience of illustration, the outer receptacle 1 and inner receptacle 3 are omitted from FIG. 1.

The inner receptacle 3 has a pair of electrode tanks 5 and 7 and one storage tank 9. The storage tank 9 stores an electrolyte solution. The storage tank 9 has an inner tank 11 and outer tanks 13. The electrolyte solution may be a mixed solution of hydrofluoric acid, for example. The electrolyte solution is supplied from a weighing tank, not shown, to the bottom of the inner tank 11, and excess part thereof overflows into the outer tanks 13 to be collected.

The storage tank 9 has a pair of covers 15 for opening and closing a top opening thereof. The pair of covers 15 are shaped rectangular in plan view (as shown in two-dot chain lines in FIG. 3). Each cover 15 is attached to a support arm 17 along a shorter side of the storage tank 9. The support arm 17 has a distal portion thereof attached to the cover 15, and a proximal portion extending out of the outer receptacle 1.

A pair of air cylinders 19 are attached to one side surface (left surface in FIG. 3) of the outer receptacle 1. These air cylinders 19 are attached in a horizontal position to the outer receptacle 1, with ends having actuating pieces movable forward and backward as opposed to each other. As shown in FIG. 2, the air cylinders 19 are attached to positions at vertically different levels. The actuating pieces of the air cylinders 19 are connected to the proximal ends of the support arms 17, respectively. When the air cylinders 19 are operated to move the actuating pieces forward, the pair of covers 15 interlocked to the support arms 17 will approach each other and cover an upper central area of the inner tank 11 (as shown in solid lines in FIG. 1). When the air cylinders 19 are operated in opposite directions to move the actuating pieces backward, the pair of covers 15 interlocked to the support arms 17 will separate from each other and move from the positions over the inner tank 11 to positions over the outer tanks 13 (as shown in two-dot chain lines in FIG. 1).

The pair of air cylinders 19 correspond to the "cover drive mechanism" in this invention.

The electrode tank 5 is formed on one side (left side in FIGS. 2 and 3) of the inner tank 11. This electrode tank 5 stores an electrolyte solution, and has an electrode 21 disposed in a position immersed in the electrolyte solution.

The electrode tank 7 is formed on the other side (right side in FIGS. 2 and 3) of the inner tank 11. This electrode tank 7 also stores the electrolyte solution, and has an electrode 23 disposed in a position immersed in the electrolyte solution. These electrode tanks 5 and 7 store the same type of electrolyte solution as supplied to the inner tank 11. However, it is preferred that its concentration is set lower than that of the electrolyte solution in the inner tank 11. When, for example, the electrolyte solution in the inner tank 11 has a ratio of hydrofluoric acid solution:isopropyl alcohol:deionized water at 1:1:1, the electrolyte solution in the electrode tanks 5 and 7, preferably, is 50 times thinner than the electrolyte solution in the inner tank 11.

A negative electrode of a power source not shown is connected to the electrode 21, for example, while a positive electrode of the power source not shown is connected to the electrode 23. The electrode 21, preferably, has a dual structure including, for example, a metal 21*a* connected to the power source not shown, and a silicon substrate 21*b* disposed on the side for contacting the electrolyte solution. Similarly, the electrode 23, preferably, has a dual structure including a metal 23*a* connected to the power source not shown, and a silicon substrate 23*b* disposed on the side for contacting the electrolyte solution. The metal can be anything that has resistance to the electrolyte solution, such as platinum, palladium, gold, silver or copper, for example. The electrolyte solution given by way of example herein includes hydrofluoric acid, and even if the metal has a certain level of resistance, metal components will be eluted. However, since the electrodes 21 and 23 have, on the electrolyte solution sides, the silicon substrates 21*b* and 23*b* which are the same type of material as the substrates under treatment, the substrates under treatment can be prevented from being contaminated by a different type metal.

Further, since the electrodes 21*a* and 23*a* are kept out of contact with the electrolyte solution by interposition of the silicon substrates 21*b* and 23*b*, degradation of the electrodes 21*a* and 23*a* can be prevented.

Each of the above metals 21*a* and 23*a* corresponds to the "first electrode member" in this invention. Each of the above silicon substrates 21*b* and 23*b* corresponds to the "second electrode member" in this invention.

A partition 25 between the electrode tank 5 and the inner tank 11 has a circular opening 27, and an ion-exchange membrane 29 mounted in this opening 27. Similarly, a partition 31 between the electrode tank 7 and the inner tank 11 has a circular opening 33, and an ion-exchange membrane 35 mounted in this opening 33. The ion-exchange membranes 29 and 35 may be formed of Nafion (registered trademark) of E. I. du Pont de Nemours & Co., for example. Preferably, the ion-exchange membranes 29 and 35 are used as held between punching plates each having a plurality of holes. This construction can prevent concentration fluctuations due to expansion of the ion-exchange membranes 29 and 35 caused by osmotic pressure, leading to variations in ion exchange action. As a result, treating unevenness can be inhibited.

Figure 4A:
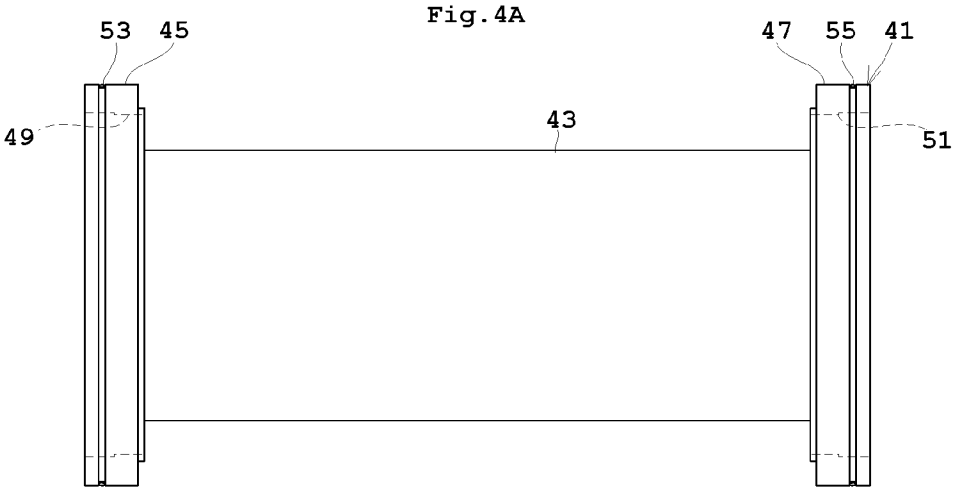
FIG. 4A is a plan view.
Figure 4B:
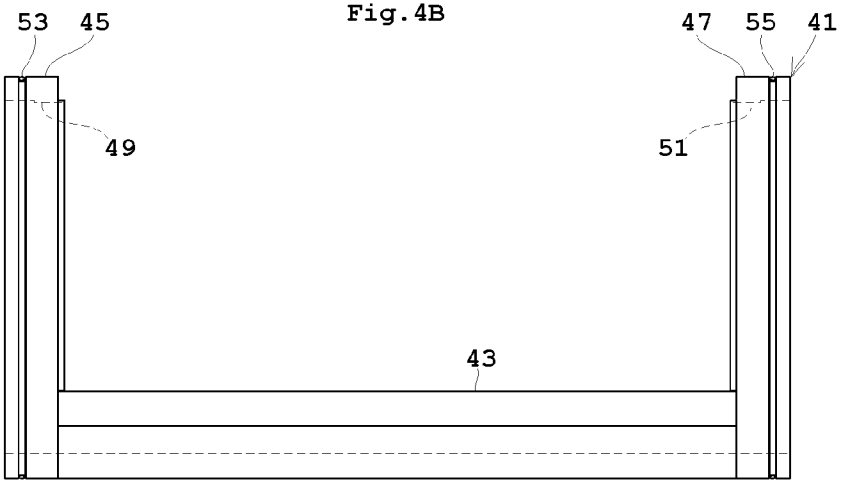
FIG. 4B is a side view.
Figure 4C:
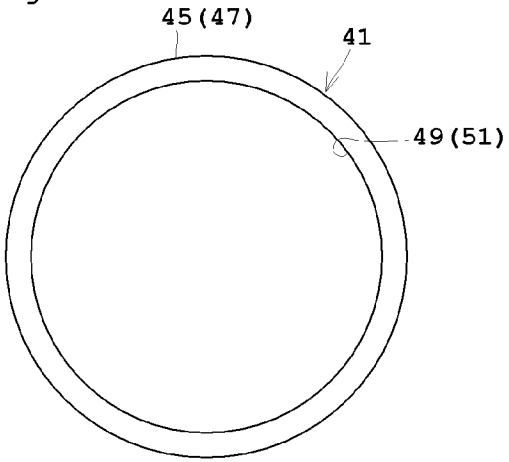
FIG. 4C is a front view.
Figure 5:
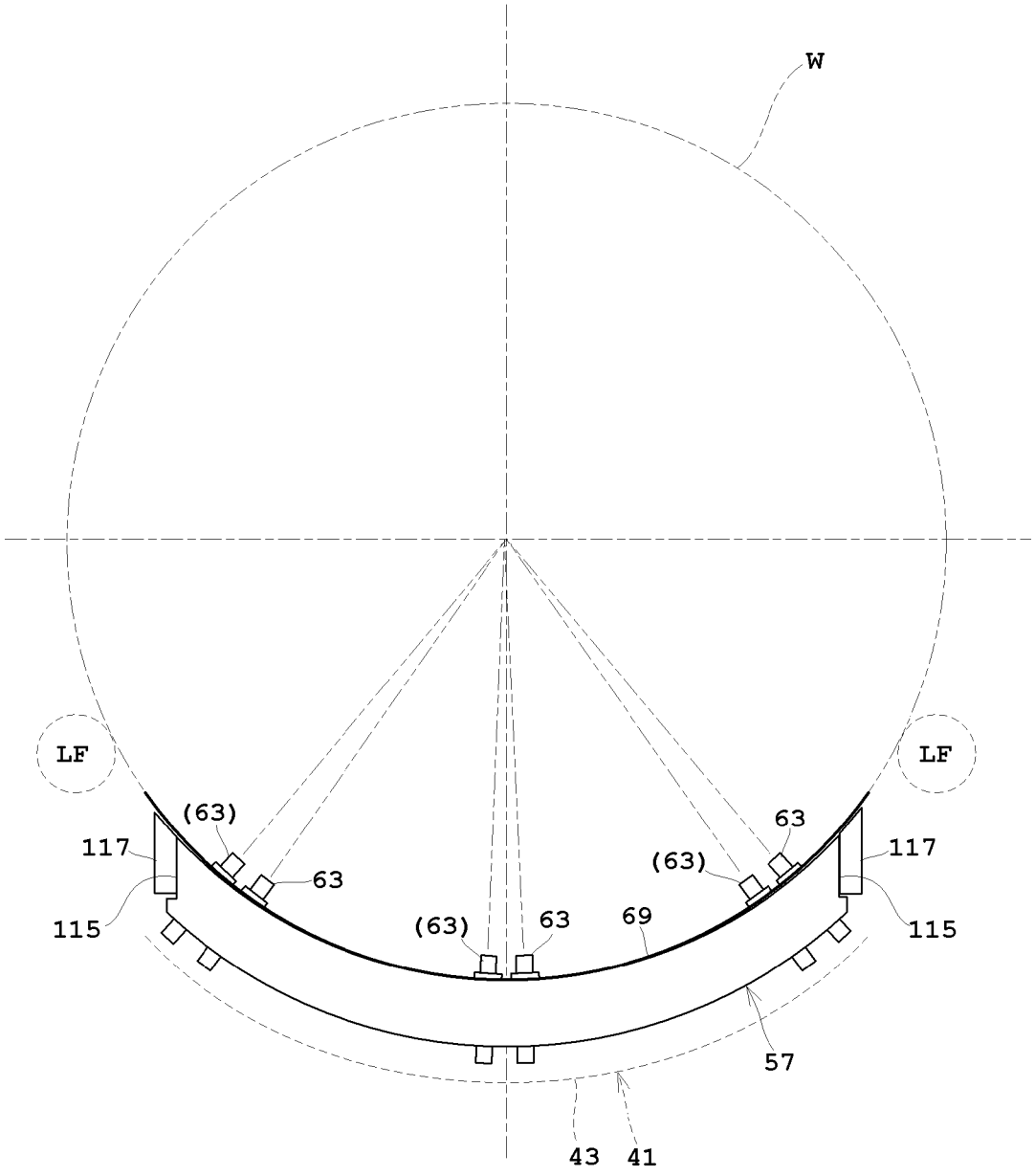
FIG. 5 is a front view of a first support unit.
Figure 6A:
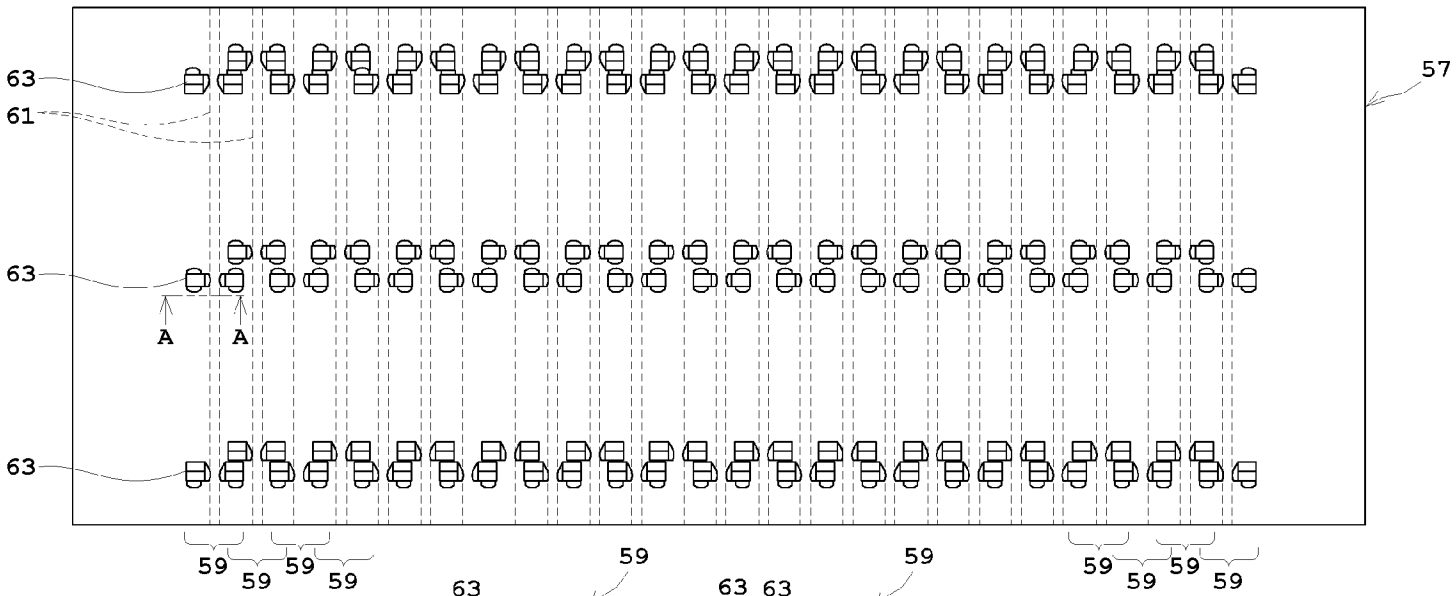
FIG. 6A is a plan view.
Figure 6B:
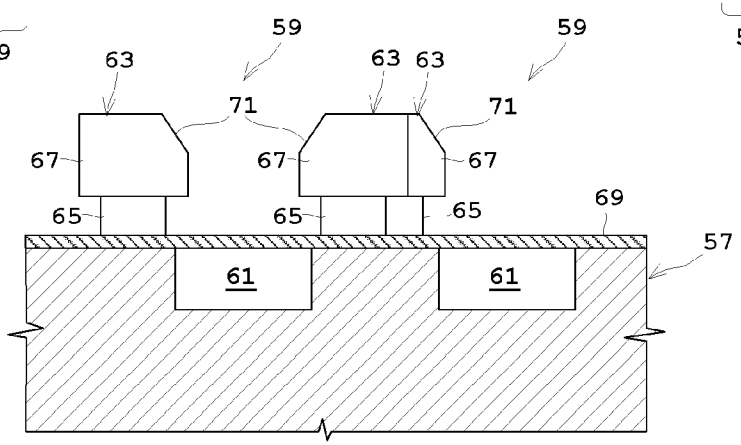
FIG. 6B is a section taken on line A-A of FIG. 6A.
Figure 7C:
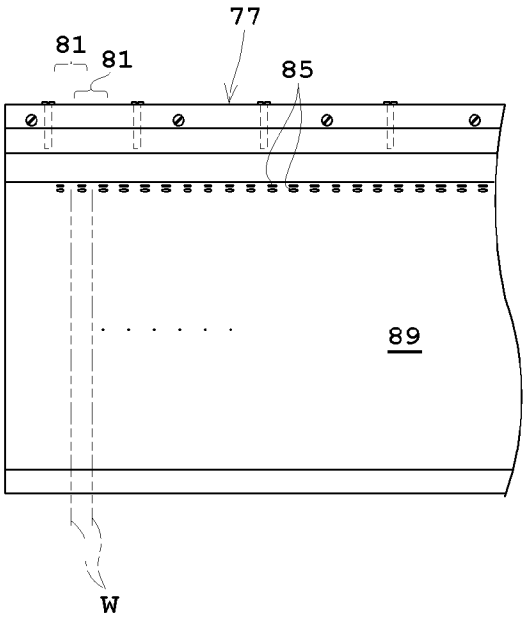
FIG. 7C shows a right second support unit.
Figure 7A:
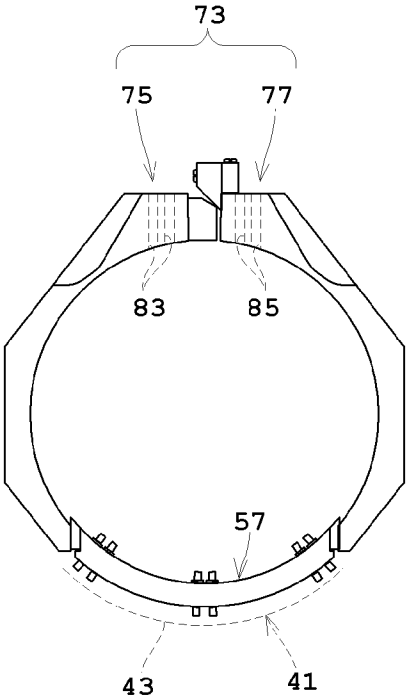
FIG. 7A is a front view.
Figure 7B:
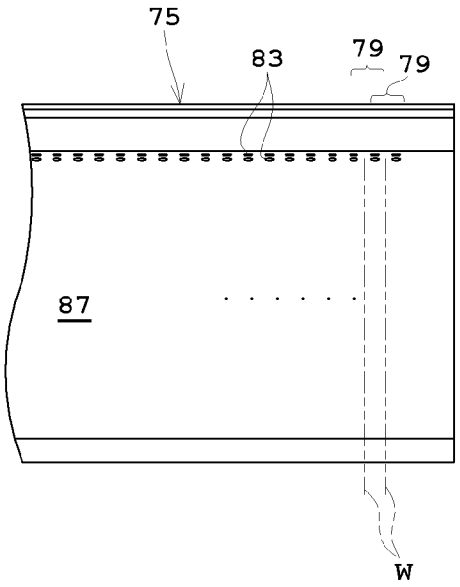
FIG. 7B shows a left second support unit.

Reference is now made to FIGS. 3 through 7. FIG. 4 includes views showing a substrate holder, in which FIG. 4A is a plan view, FIG. 4B is a side view, and FIG. 4C is a front view. FIG. 5 is a front view of a first support unit. FIG. 6 includes views showing the first support unit, in which FIG. 6A is a plan view, and FIG. 6B is a section taken on line A-A of FIG. 6A. FIG. 7 includes views showing a second support unit, in which FIG. 7A is a front view, FIG. 7B shows a left second support unit, and FIG. 7C shows a right second support unit.

A substrate holder 41 is mounted in the inner tank 11 of the storage tank 9. This substrate holder 41 includes a holder base 43 and holder ends 45 and 47. The holder base 43 has a space for accommodating a plurality of substrates. The holder ends 45 and 47 have through-bores 49 and 51 formed therein. The holder ends 45 and 47 have a cylindrical outward appearance, and O-rings 53 and 55 are mounted on cylindrical outer peripheries thereof. These O-rings 53 and 55 are provided in order to attach the substrate holder 41 in a liquid-tight condition to the partitions 25 and 31 by means of mounting members not shown. In other words, the substrate holder 41 is disposed in a position to have the through-bores 49 and 51 aligned to the electrodes 21 and 23. This arrangement facilitates passage of the electric field formed by the electrodes 21 and 23, thereby efficiently causing a chemical reaction on a plurality of substrates.

The holder base 43 has a first support unit 57 as shown in FIGS. 5 and 6 (but not shown in FIG. 4). As shown in FIG. 5, the first support unit 57, when seen from the front, presents an arcuate shape having a chord shorter than the diameter of the substrates or wafers W. The first support unit 57 has a plurality of first support elements 59. In the case of treating 25 wafers W at a time, for example, the first support unit 57 has 25 first support elements 59 in the direction of arrangement of the wafers W. Since the first support unit 57 is arcuate with the chord shorter than the diameter of the wafers W, a lifter LF shown in FIG. 5 can engage portions below maximum diameter portions of the wafers W. Therefore, stress is hardly imposed on the wafers W at a time of transportation, thereby preventing damage and the like to the wafers W.

The first support elements 59 contact only lower parts of circumferential surfaces of the wafers W to support these parts in a liquid-tight condition. The first support elements 59 have grooves 61 formed in upper surfaces thereof. The grooves 61 have a width slightly larger than the thickness of wafers W. Guide pins 63 are mounted in positions opposed to one another across each groove 61. When seen from the plane direction of the wafers W, as shown in FIG. 5, the guide pins 63 are arranged in three positions including a middle position and right and left positions. Each guide pin 63 has a central axis extending toward the center of a wafer W. Each guide pin 63 has a base 65 and a guide portion 67. An elastic member 69 is applied to the surfaces of the first support elements 59. The base 65 of each guide pin 63 projects from the surface of the elastic member 69, and the guide portion 67 is formed on an upper part of the base 65. The guide portion 67 has a slope 71 on a side thereof adjacent the groove 61, and protrudes from the base 65 toward the groove 61. The elastic member 69 is formed of a material having resistance to the electrolyte solution, such as tetrafluoroethylene resin, for example.

The first support elements 59 adjoin one another in the direction of arrangement of the wafers W. The guide pins 63 of adjoining first support elements 59 are mounted in staggered (zigzag) positions. This configuration can shorten the first support unit 57 in the direction of arrangement of the wafers W, to attain compactness of the apparatus. The first support unit 57, second support unit 73 and guide pins 63 are formed of a synthetic resin having resistance to the electrolyte solution, such as vinyl chloride resin (polyvinyl chloride, PVC), for example.

The substrate holder 41 has the second support unit 73 disposed on an upper portion thereof as shown in FIG. 7. The second support unit 73 includes a left second support unit 75 and a right second support unit 77. The left second support unit 75 and right second support unit 77, when seen from the front, present a shape of character C and a shape of reversed character C. The second support unit 73 contacts and supports in a liquid-tight condition the parts of the circumferential surfaces of the wafers W remaining of the circumferential surfaces of the wafers W supported in the liquid-tight condition by the first support unit 57. The left second support unit 75 includes a plurality of left second support elements 79 adjoining one another in the direction of arrangement of the wafers W, each support element 79 supporting one wafer W. The right second support unit 77 includes a plurality of right second support elements 81 adjoining one another in the direction of arrangement of the wafers W, each support element 81 supporting one wafer W. Exhaust passages 83 are formed in an upper inner surface at boundaries between adjacent left second support elements 79. The exhaust passages 83 are formed in two locations along the circumferential surface of each wafer W. The exhaust passages 83 have upper openings thereof located above the level (sign SL in FIG. 1) of the electrolyte solution stored in the storage tank 9. Exhaust passages 85 are formed in an upper inner surface at boundaries between adjacent right second support elements 81, as between adjacent left second support elements 79. The exhaust passages 85 are formed in two locations along the circumferential surface of each wafer W. The left second support unit 75 has an elastic member 87 applied to the inner surface thereof, and the right second support unit 77 has an elastic member 89 applied similarly. The elastic members 87 and 89 are applied in a way not to block the exhaust passages 83 and 85.

The above elastic members 87 and 89 are formed of a material having resistance to the electrolyte solution. This material may be tetrafluoroethylene resin, for example, but preferably is softer than the elastic member 69 of the first support unit 57. In other words, the elastic member 69 of the first support unit 57, preferably, is harder than the elastic members 87 and 89.

As shown in FIG. 1, the second support unit 73 is constructed openable and closable, and attachable to and detachable from the first support unit 57. Specifically, the left second support unit 75 has pedestals 91, fulcrums 93, a rocking arm 95 and connectors 97. The pedestals 91, with the first support unit 57 disposed in between, are fixed to the bottom of the inner tank 11. The fulcrums 93 are arranged in portions at one end of the rocking arm 95 attached to the pedestals 91. The other end of the rocking arm 95 is fixed to an outer peripheral portion of the left second support unit 75. The right second support unit 77 has pedestals 99, fulcrums 101, a rocking arm 103 and connectors 105, as does the left second support unit 75.

Each connector 97 has a suspension member 107, a slide pin 109 and a fixed member 111. The suspension member 107 is attached to and suspended from a lower surface of one of the covers 15. The suspension member 107 has a slot 113 formed to extend therethrough in the direction of the plane of FIG. 1. The fixed member 111 is fixed to an upper peripheral surface of the left second support unit 75, and has the slide pin 109 inserted in the slot 113. The slide pin 109 is freely movable in the slot 113. Although the reference signs are omitted, the connectors 105 have the same construction as the connectors 97. Thus, when the pair of air cylinders 19 are operated to open the pair of covers 15, as shown in two-dot chain lines in FIG. 1, the left second support unit 75 and right second support unit 77 rock away from each other about the fulcrums 93 and 101, to open an area over and opposite lateral areas of the substrate holder 41, leaving the first support unit 57 as it is. When the pair of air cylinders 19 are operated in reverse directions to close the pair of covers 15, the left second support unit 75 and right second support unit 77 rock toward each other about the fulcrums 93 and 101, to close the area over and opposite lateral areas of the substrate holder 41. As a result, wafers W are placed in a sealed state in the substrate holder 41 relative to the electrolyte solution in the inner tank 11. At this time, the forces imparted from the left second support unit 75 and right second support unit 77 act toward the centers of wafers W as indicated by two-dot chain line arrows in FIG. 1.

As described above, the second support unit 73 is driven between the closed position and open position by the pair of air cylinders 19 which primarily drive the pair of covers 15. The air cylinders 19 serving the dual purpose can simplify the construction relating to drive, and facilitate control of various components at times of transporting the wafers W. The pair of air cylinders 19 correspond to the "drive mechanism" in this invention.

Figure 8A:
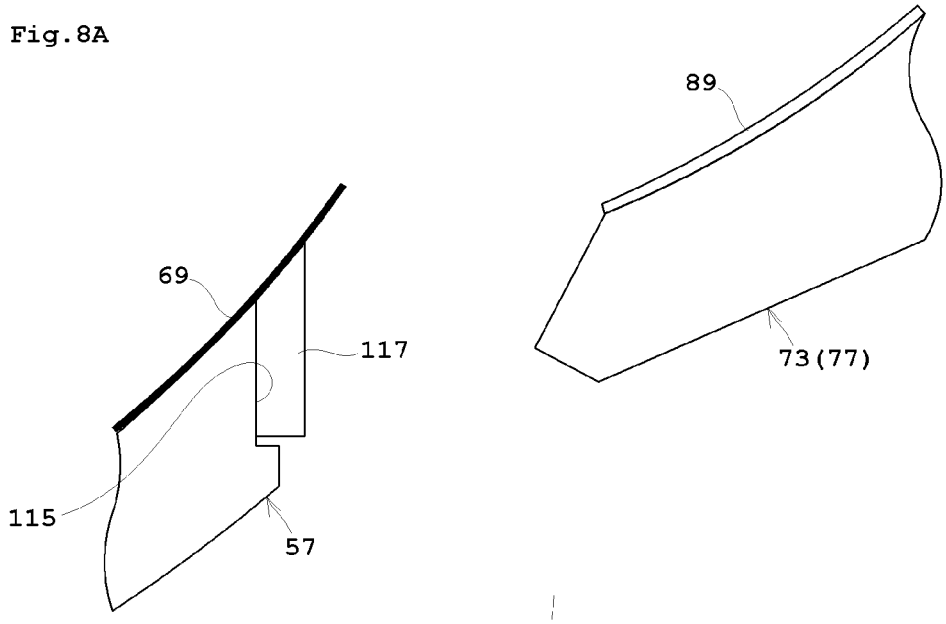
FIG. 8A shows a separated state.
Figure 8B:
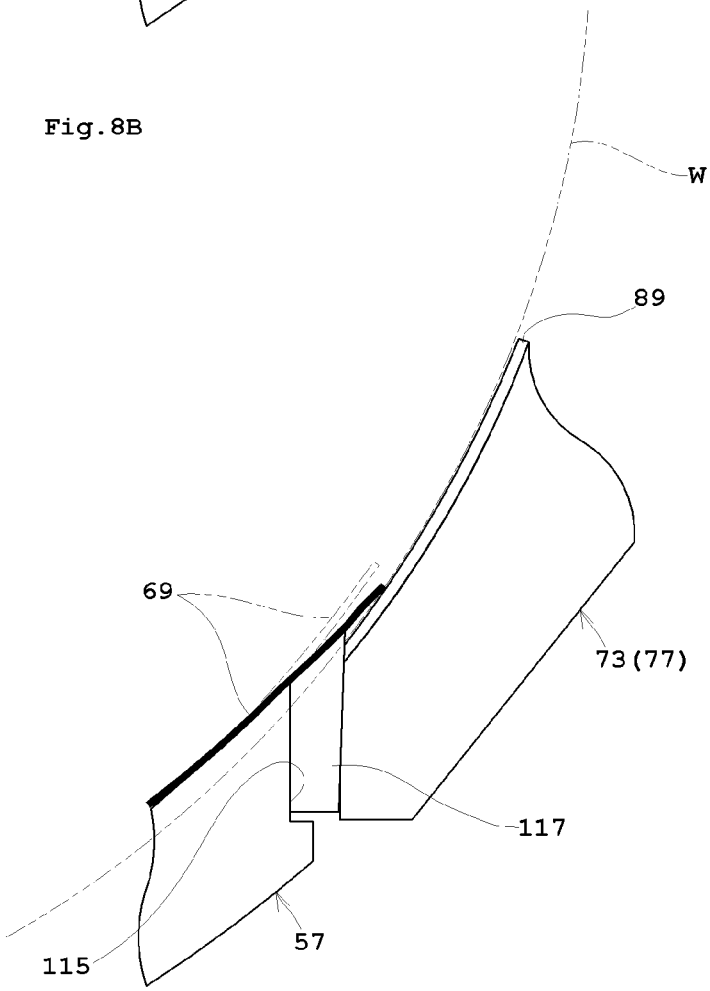
FIG. 8B shows a connected state.

Reference is now made to FIG. 8. FIG. 8 includes schematic views showing operation at a time of connecting the first support unit and second support unit, in which FIG. 8A shows a separated state, and FIG. 8B shows a connected state.

The first support unit 57 has buffer members 117 attached to side surfaces 115 thereof. The buffer members 117 may be formed of a sponge material having resistance to the electrolyte solution, for example. These buffer members 117 lessen a shock occurring when the second support unit 73 moves into contact with the first support unit 57, and also maintain a liquid-tight condition at junctions. The elastic member 69 of the first support unit 57 has ends extending outward of the buffer members 117. This feature can maintain the liquid-tight condition at the junctions when the first support unit 57 and second support unit 73 in a separated state as shown in FIG. 8A are connected as shown in FIG. 8B.

Figure 9A:
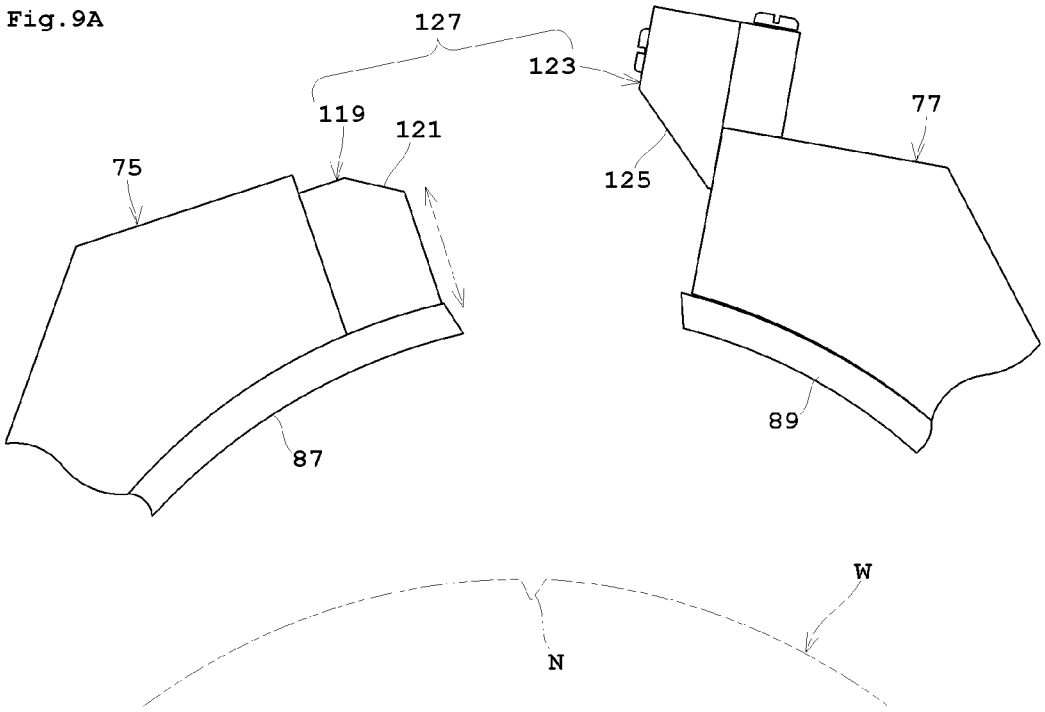
FIG. 9A shows a separated state.
Figure 9B:
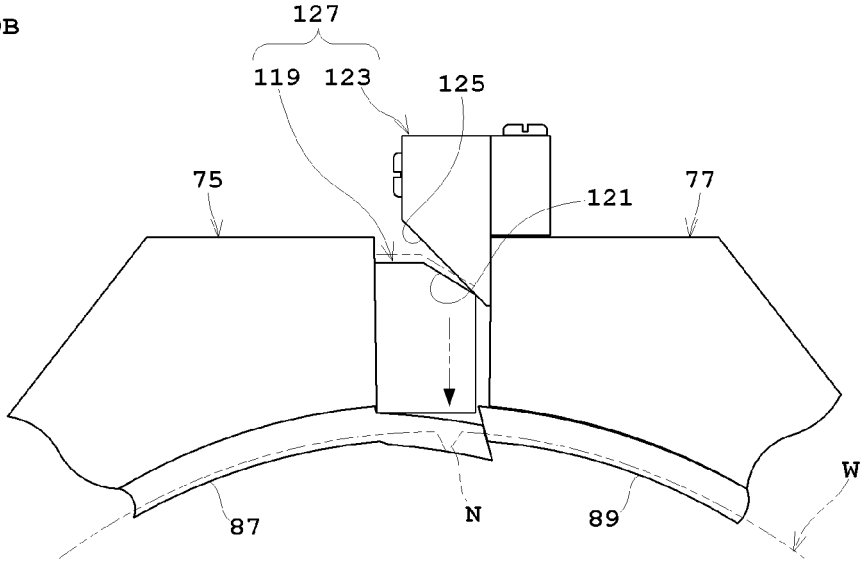
FIG. 9B shows a connected state.

Reference is made to FIG. 9. FIG. 9 includes schematic views showing operation at a time of connecting the left second support unit and right second support unit, in which FIG. 9A shows a separated state, and FIG. 9B shows a connected state.

The left second support unit 75 has a slide member 119. This slide member 119 is mounted in contact with an outer surface of the elastic member 87, and attached to an upper right surface of the left second support unit 75 to be slidable up and down (in directions toward and away from the centers of wafers W) in the state of the left second support unit 75 being closed. The slide member 119 has a slope 121 inclined toward the right second support unit 77. The right second support unit 77 has a pressing member 123. This pressing member 123 is fixedly attached to an upper left surface of the right second support unit 77. The pressing member 123 has a slope 125 formed thereon which has a gentler inclination angle than the slope 121. The above slide member 119 and pressing member 123 constitute a notch pressing mechanism 127. Thus, when the left second support unit 75 and right second support unit 77 in a separated state as shown in FIG. 9A are connected as shown in FIG. 9B, the pressing member 123 will move the slide member 119 toward the centers of wafers W, whereby the elastic member 87 of the left second support unit 75 is moved toward notches N of wafers W. As a result, the notches N of wafers W are covered by the elastic member 87. This can prevent the electrolyte solution on both surfaces of each wafer W from circulating through the notch N. This construction can inhibit concentration fluctuations of the electrolyte solution to improve the uniformity of treatment.

The notch pressing mechanism 127 may be modified such that the pressing member 123 is attached to the left second support unit 75, and the slide member 119 to the right second support unit 77.

Figure 10A:
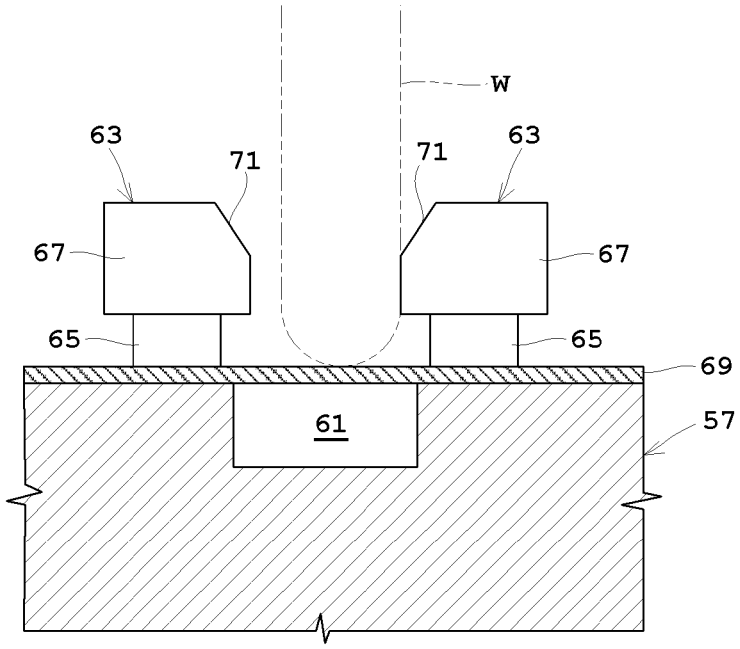
FIG. 10A shows a state of the substrate placed.
Figure 10B:
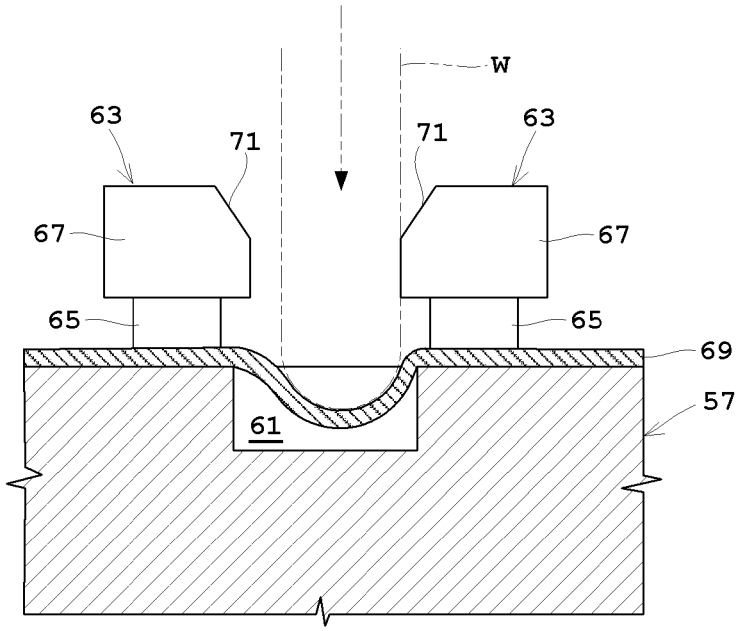
FIG. 10B shows a state of the substrate pressed by the second support unit.

Reference is made to FIG. 10. FIG. 10 includes schematic views showing states of a substrate placed on the first support unit, in which FIG. 10A shows a state of the substrate placed, and FIG. 10B shows a state of the substrate pressed by the second support unit.

When, with the second support unit 73 separated from the first support unit 57, a lifter not shown places wafers W on the first support unit 57, the lower surface of each wafer W is guided by the guide pins 63 and located above the groove 61 as shown in FIG. 10A. And when the second support unit 73 is connected to the first support unit 57 as described above, each wafer W is pressed from upper right and left of the wafer W. Then, as shown in FIG. 10B, the elastic member 69 is pressed by the lower surface of the wafer W into the groove 61. The elastic member 69 of the first support unit 57 is set harder than the elastic members 87 and 89 of the second support unit 73. Consequently, when the second support unit 73 supports and presses the wafers W, the positions of the wafers W cannot move excessively close to the first support unit 57. Therefore, the entire circumferential surfaces of the wafers W including the lower parts and the remaining parts thereof can be supported uniformly and in a liquid-tight condition relative to the electrolyte solution. Since the circumferential surface of each wafer W enters the groove 61, parts of the front and back surfaces including the circumferential surface of the wafer W can be supported, and the electrolyte solution between adjoining wafers W will not circulate. As a result, the concentration of the electrolyte solution acting on the wafers W remains stable, to realize stable treatment.

Figure 11:
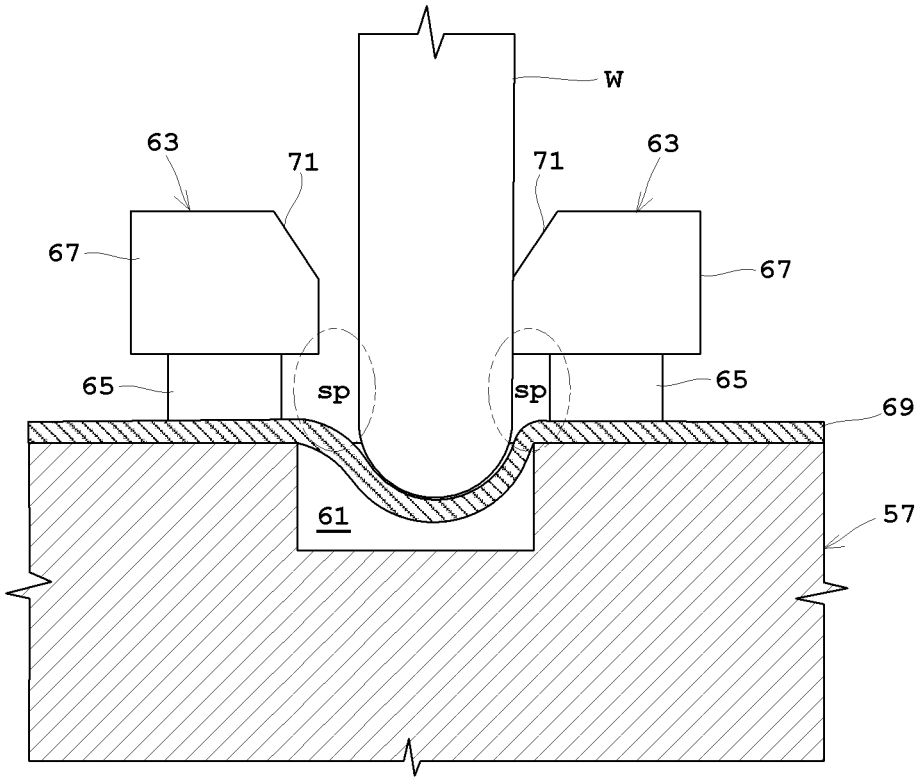
FIG. 11 is a schematic view showing a state at a time of chemical reaction.

As shown in FIG. 11, spaces sp occur between the bases 65 of the guide pins 63 and the surfaces of each wafer W. These spaces sp permit the electrolyte solution to stagnate between the bases 65 and the surfaces of the wafer W. This minimizes locations where the chemical reaction does not easily take place at the time of anodizing treatment.

The anodizing apparatus constructed as described above first supplies the electrolyte solution of predetermined concentration to the storage tank 9, and keeps the electrolyte solution of predetermined concentration to the pair of electrode tanks 5 and 7. Next, the pair of air cylinders 19 are operated to open the pair of covers 15 (see the two-dot chain lines in FIG. 1). At this time, as interlocked to this operation, the left second support unit 75 and right second support unit 77 separate from each other, and the electrolyte solution in the storage tank 9 flows into the substrate holder 41. Next, a plurality of wafers W are transported by the lifter, and placed on the first support unit 57 (see FIG. 10A). Next, the pair of air cylinders 19 are operated in the opposite directions to close the pair of covers 15 (see the solid lines in FIG. 1). At this time, as interlocked to this operation, the left second support unit 75 and right second support unit 77 connect to the first support unit 57 (see FIGS. 8A and 8B), which operates the notch pressing mechanism 127 (see FIGS. 9A and 9B). Consequently, the plurality of wafers W, with the entire circumferential surfaces including the notches N thereof sealed up, are stored in the substrate holder 41 in a liquid-tight condition relative to the electrolyte solution in the storage tank 9. When, in this state, the electrode 21 and electrode 23 are electrified, a chemical reaction takes place to render the plurality of wafers W porous. Although gas is generated by the anodizing reaction, gas bubbles are discharged out of the substrate holder 41 through the exhaust passages 83 and 85 of the second support unit 73. This can prevent treating unevenness due to the gas bubbles.

Upon completion of a chemical reaction process of a predetermined time, the electrode 21 and electrode 23 are de-electrified, and the pair of air cylinders 19 are operated to open the pair of covers 15. As interlocked to the latter operation, the left second support unit 75 and right second support unit 77 are separated from each other, and the electrolyte solution in the storage tank 9 flows into the substrate holder 41. In this way, the electrolyte solution is refreshed for treatment of a next batch of wafers W. Next, the plurality of treated wafers W are held and transported out of the substrate holder 41 by the lifter.

According to the apparatus in this embodiment, the pair of air cylinders 19 separate the first support unit 57 and second support unit 73 arranged in the storage tank 9. In this state, a plurality of wafers W are respectively placed between the first support elements 59 of the first support unit 57, whereby only lower portions of the circumferential surfaces of the wafers W are supported in a liquid-tight condition relative to the electrolyte solution. When the second support unit 73 is connected to the first support unit 57 by the pair of air cylinders 19, the plurality of wafers W are supported by the left second support elements 79 and right second support elements 81, with the remaining portions of the circumferential surfaces of the wafers W put in a liquid-tight condition relative to the electrolyte solution. Consequently, the entire circumferential surfaces of the wafers W are now in the liquid-tight condition relative to the electrolyte solution. After the anodizing reaction is completed, the second support unit 73 is separated from the first support unit 57 by the pair of air cylinders 19, and the plurality of wafers W supported by the first support unit 57 are unloaded therefrom. Thus, the substrate holder 41 having the first support unit 57 and second support unit 73 attachable to and detachable from each other by the pair of air cylinders 19 enables a plurality of wafers W to be mechanically loaded into and unloaded from the storage tank. As a result, the anodizing apparatus provided is well suited for automation and batch treatment.

According to the apparatus in this embodiment, a plurality of wafers W are held by the substrate holder 41 mounted in the storage tank 9, and the electrodes 21 and 23 arranged in the pair of electrode tanks 5 and 7 are electrified. Then, ions move between the pair of electrode tanks 21 and 23, which cause a chemical reaction on the plurality of wafers W through the ion-exchange membranes 29 and 35. This enables batch treatment for treating a plurality of wafers W at a time. The concentration of the electrolyte solution stored in the electrode tanks 5 and 7 is set lower than the concentration of the electrolyte solution stored in the storage tank 9. Since the chemical reaction is inhibited in the electrode tanks 5 and 7 compared with that in the storage tank 9, a local chemical reaction occurring to each of the electrodes 21 and 23 in the electrode tanks 5 and 7 can be inhibited. As a result, degradation of the electrodes 21 and 23 can be inhibited, and the operating rate of the apparatus can be improved.

Figure 12A:
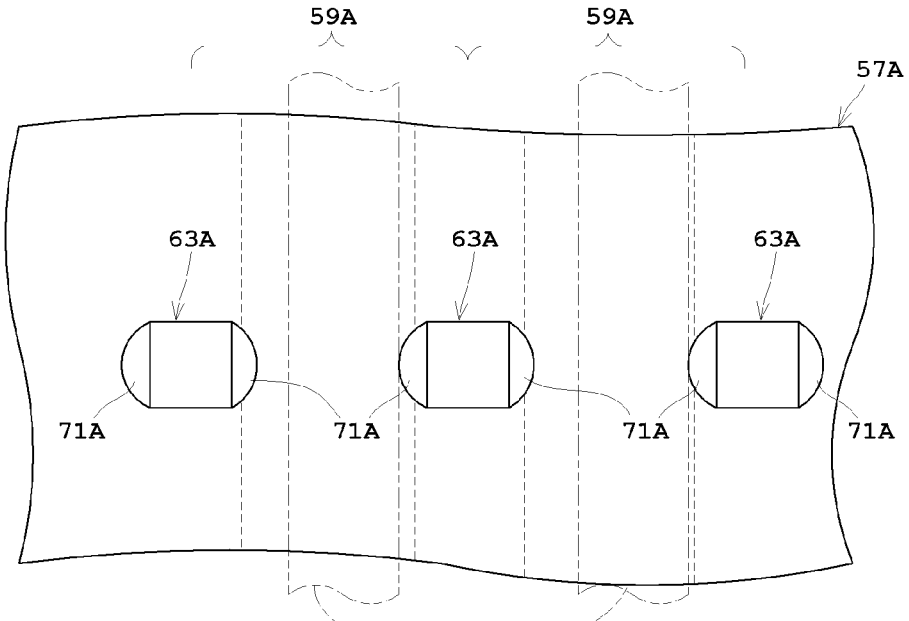
FIG. 12A is a plan view.
Figure 12B:
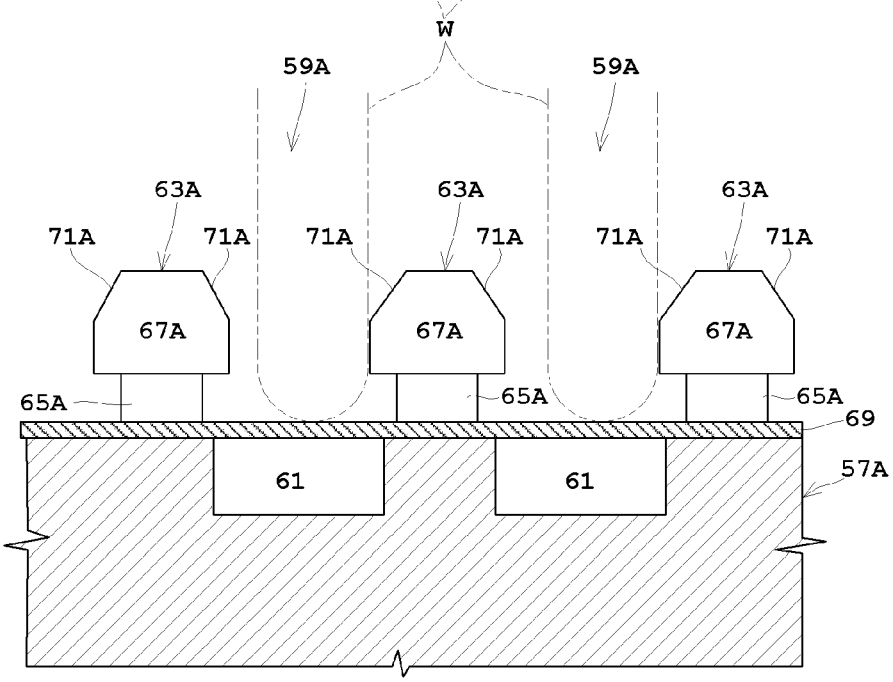
FIG. 12B is a view in vertical section.

This invention is not limited to the foregoing embodiment, but may be modified as follows:

(1) In the foregoing embodiment, the first support unit 57 includes the first support elements 59 each having a pair of guide pins 63 for acting on the front and back surfaces of each wafer W, such guide pins 63 being in zigzag positions in the direction of arrangement of the wafers W. However, the first support unit 57 of this invention is not limited to such construction, but may be constructed as shown in FIG. 12, for example. FIG. 12 includes views showing a modification of the first support unit, in which FIG. 12A is a plan view, and FIG. 12B is a view in vertical section.

Each of these first support elements 59A includes guide pins 63A on both sides of each groove 61. Each guide pin 63A has a guide 67A disposed on a base 65A and protruding toward the grooves 61. This guide 67A has guide faces 71A on both sides in the direction of arrangement of wafers W. The guide pins 63A are not arranged zigzag, but arranged linearly in the direction of arrangement of wafers W. Since each guide pin 63A has the guide faces 71A on both sides, adjoining first support elements 59A can share one guide pin 63A. The first support unit 57A can be shortened in the direction of arrangement of wafers W, to contribute to compactness of the apparatus.

Figure 13:
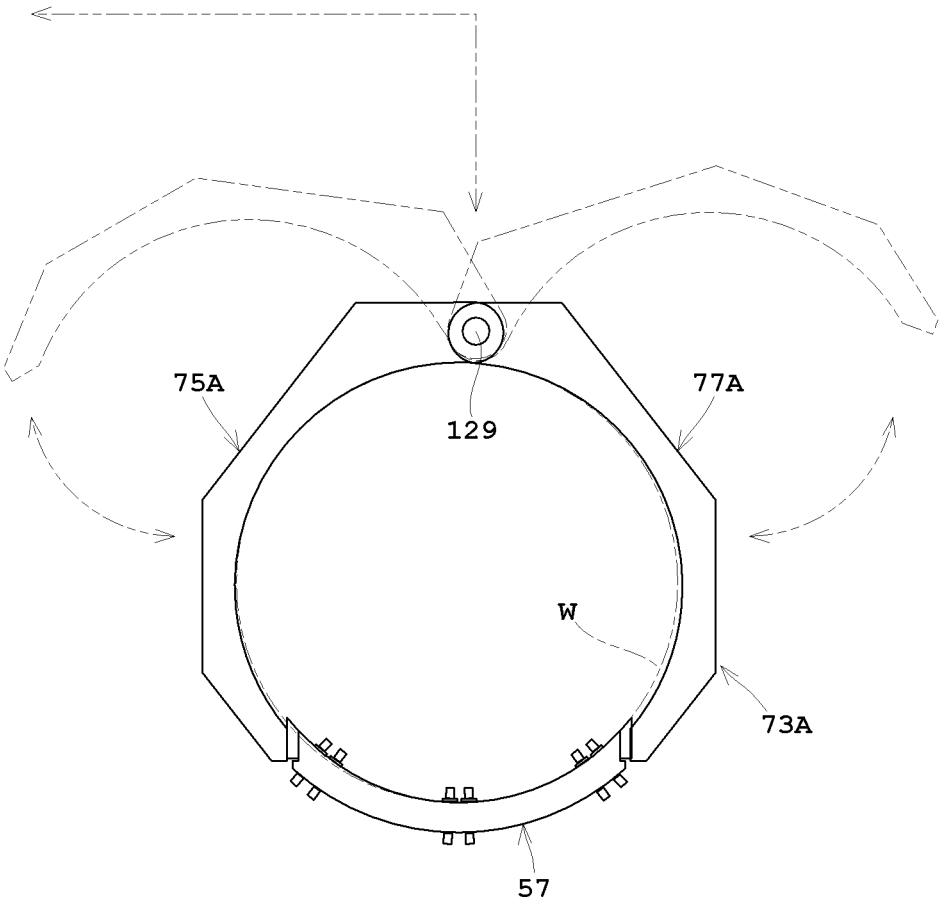
FIG. 13 is a view showing a modification of the second support unit.

(2) In the foregoing embodiment, the left second support unit 75 and right second support unit 77 are rocked about fulcrums 93 and 101 at the bottom of the storage tank 9. This invention is not limited to this construction. For example, a construction as shown in FIG. 13 may be employed. FIG. 13 is a view showing a modification of the second support unit.

This modification provides a second support unit 73A including a left second support unit 75A and a right second support unit 77A having an upper fulcrum 129. Although this construction requires a mechanism for displacing the second support unit 73A at times of loading and unloading wafers W, the mechanism in the storage tank 9 becomes unnecessary, and thus can simplify the construction of the storage tank 9.

Figure 14:
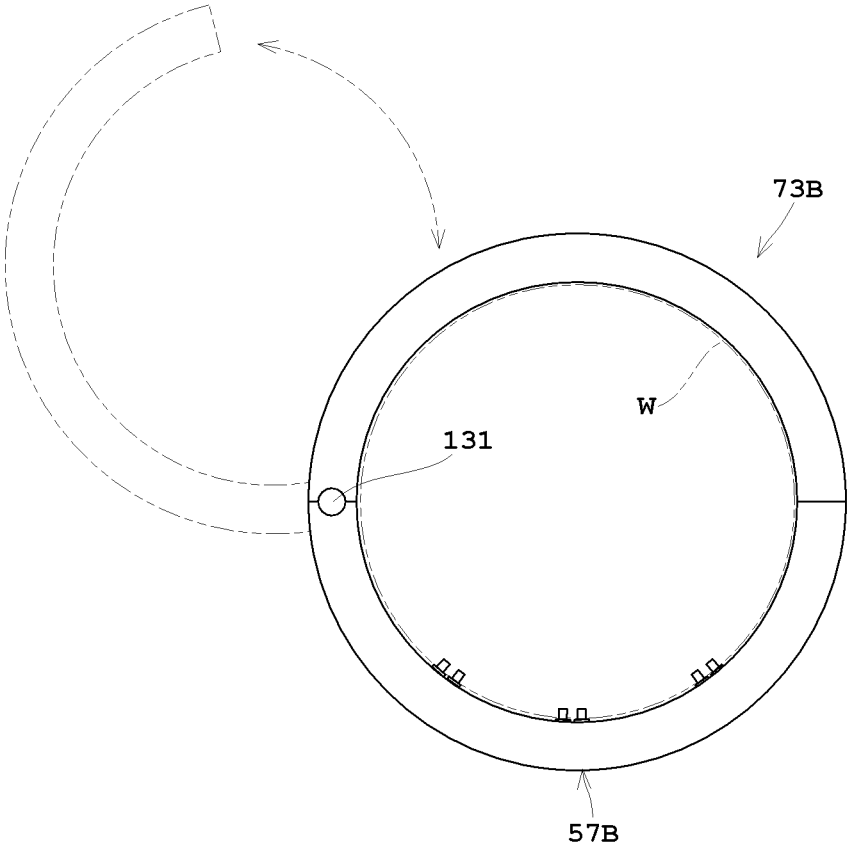
FIG. 14 is a view showing a modification of the first support unit and second support unit.

(3) The foregoing embodiment provides the first support unit 57 and second support unit 73, and the second support unit 73 consists of the left second support unit 75 and right second support unit 77. This invention is not limited to the above construction, but may employ a construction as shown in FIG. 14, for example. FIG. 14 is a view showing a modification of the first support unit and second support unit.

With these first support unit 57B and second support unit 73B, the second support unit 73B is not divided. The first support unit 57B and second support unit 73B are divided up and down adjacent the maximum diameter of wafers W. The first support unit 57B and second support unit 73B are constructed such that the second support unit 73B is rockable about a fulcrum 131 relative to the first support unit 57B. This construction can reduce the number of parts to attain low cost. The construction of the apparatus can also be simplified.

Figure 15:
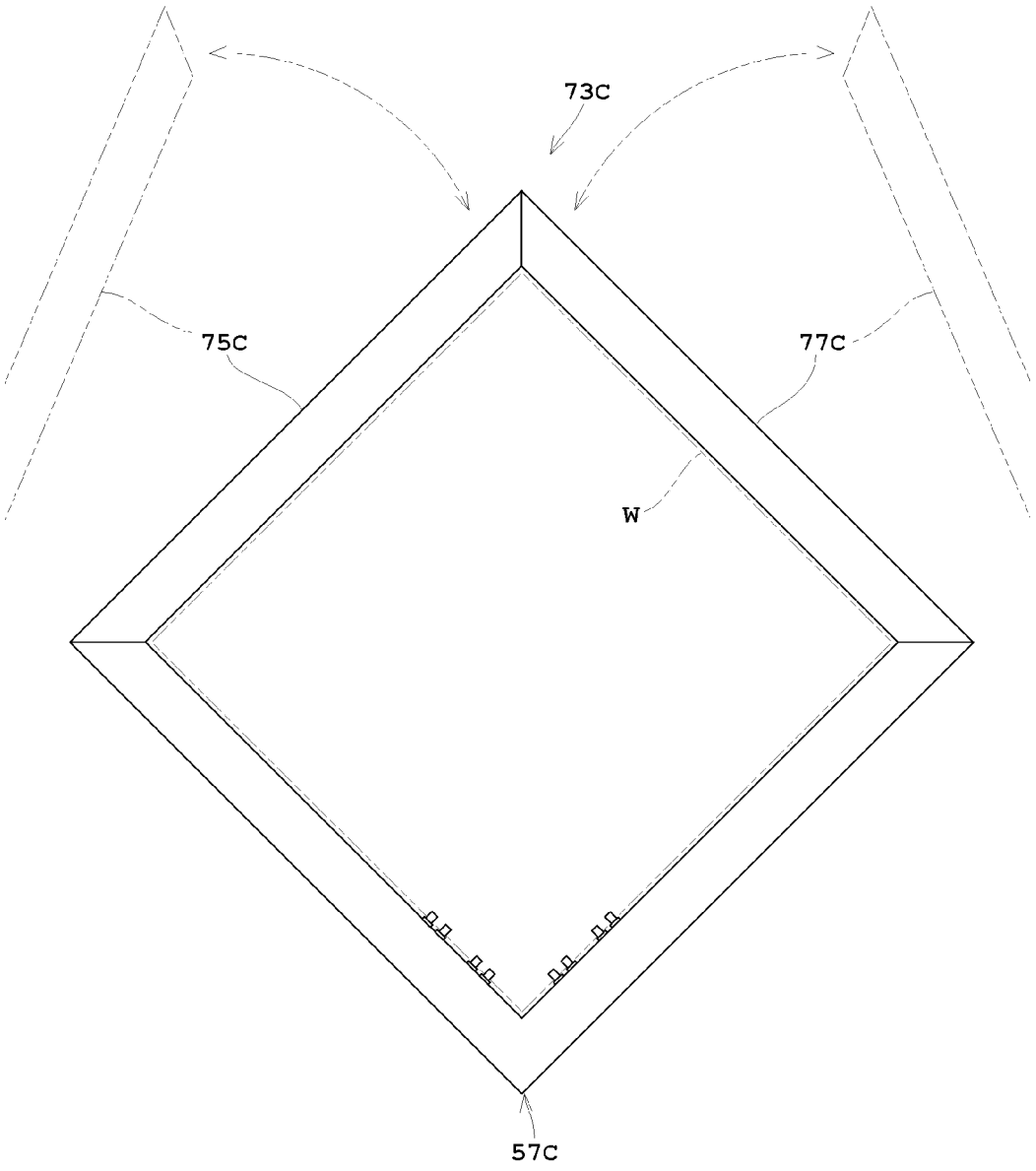
FIG. 15 is a view showing another modification of the first support unit and second support unit.

(4) The foregoing embodiment has been described as treating circular wafers W, but this invention can treat also other substrates than the circular wafers W, such as square substrates, for example. For this purpose, a construction as shown in FIG. 15, for example, may be employed. FIG. 15 is a view showing another modification of the first support unit and second support unit.

This modification treats square substrates W in a position having diagonally opposed corners pointing in the vertical (horizontal) direction. In this case, a first support unit 57C is V-shaped. Further, a second support unit 73C is divided into a left second support unit 75C and a right second support unit 77C. Such construction, combined with a construction similar to that in the foregoing embodiment, can treat square substrates.

For treating the square substrates W, the modifications (2) and (3) above may also be employed.

(5) The foregoing embodiment provides the notch pressing mechanism 127. However, the notch pressing mechanism 127 is not essential to this invention.

(6) The foregoing embodiment provides the exhaust passages 83 and 85. Such exhaust passages 83 and 85 are not required where the influence of bubbles generated by the treatment is small or negligible.

(7) In the foregoing embodiment, the second support unit 73 is driven by the pair of air cylinders 19 which open and close the pair of covers 15. Instead, a drive mechanism may be provided for exclusive use in driving the second support unit 73.

(8) In the foregoing embodiment, the electrodes 21 and 23 have the dual structure including metals 21*a*, 23*a* and silicon substrates 23*a*, 23*b*. However, this construction is not indispensable to this invention. That is, the electrodes 21 and 23 may have only the metals 21*a*, 23*a*. Even with this construction, since the concentration of the electrolyte solution in the electrode tanks 5 and 7 is set low, degradation of the metals 21*a* and 23*a* can be inhibited.

This invention may be embodied in other specific forms without departing from the spirit or essential attributes thereof and, accordingly, reference should be made to the appended claims, rather than to the foregoing specification, as indicating the scope of the invention.

What is claimed is:

1. An anodizing apparatus for causing an anodizing reaction on substrates immersed in an electrolyte solution, comprising:

a storage tank for storing the electrolyte solution;

a substrate holder mounted in the storage tank, and including a first support unit having a plurality of first support elements arranged in a direction of arrangement of the substrates for contacting and supporting, in a liquid-tight condition, only lower portions of circumferential surfaces of the substrates, and a second support unit attachable to and detachable from the first support unit and having a plurality of second support elements arranged in the direction of arrangement of the substrates for contacting and supporting, in a liquid-tight condition, remaining portions of the circumferential surfaces of the substrates other than the lower portions supported by the first support elements;

a drive mechanism for separating the first support unit and the second support unit when placing the plurality of substrates in the substrate holder and when unloading the plurality of substrates from the substrate holder, and for connecting the first support unit and the second support unit after the plurality of substrates are placed in the substrate holder;

wherein the second support unit includes a left second support unit having left second support elements as the second support elements for supporting left sides of the remaining portions of the circumferential surfaces of the substrates, and a right second support unit having right second support elements as the second support elements for supporting right sides of the remaining portions of the circumferential surfaces of the substrates; and wherein the left second support unit and the right second support unit have fulcrums, respectively, have the first support unit in between, and are rockable away from each other in a plane defined by said first and second support units when separating from the first support unit.

2. The apparatus according to claim 1 wherein the substrate holder assumes a cylindrical appearance when the first support unit and the second support unit are connected, and includes ion-exchange membranes disposed at one end and the other end thereof in the direction of arrangement of the substrates for permitting passage of ions and blocking passage of part of the electrolyte solution in the substrate holder and part of the electrolyte solution in the storage tank.

3. The apparatus according to claim 1 wherein the first support elements support lower portions of the circumferential surfaces which correspond to chords shorter than diameters of the substrates.

4. The apparatus according to claim 1 wherein the fulcrums are located in positions at a bottom of the storage tank.

5. The apparatus according to claim 1 further comprising a pair of covers for opening and closing an upper opening of the storage tank, wherein the drive mechanism is used also as a cover drive mechanism for driving the pair of covers in opening and closing operations.

6. The apparatus according to claim 2 further comprising a pair of covers for opening and closing an upper opening of the storage tank, wherein the drive mechanism is used also as a cover drive mechanism for driving the pair of covers in opening and closing operations.

7. The apparatus according to claim 1 wherein the second support elements have exhaust passages extending from inner surfaces to outer surfaces thereof, with upper openings thereof located above a solution level in the storage tank.

8. The apparatus according to claim 1 wherein the first support elements have an elastic member applied to inner surfaces thereof, and grooves formed in positions where lower surfaces of the substrates are placed.

9. The apparatus according to claim 8 wherein the first support elements have guide pins arranged at opposite sides of each groove for guiding the substrates being placed and preventing turnover of the substrates.

10. The apparatus according to claim 9 wherein each of the guide pins has a base projecting from the elastic member, and a guide portion formed on an upper part of the base and projecting from the base toward one of the substrates.

11. The apparatus according to claim 1 wherein a junction between the left second support unit and the right second support unit has a notch pressing mechanism for pressing notches of the substrates through elastic members provided on inner surfaces of the left second support unit and the right second support unit.

12. The apparatus according to claim 11 wherein the notch pressing mechanism includes a slide member provided on one of the left second support unit and the right second support unit to be slidable toward centers of the substrates, and a pressing member provided on the other of the left second support unit and the right second support unit for pressing the slide member when the left second support unit and the right second support unit join each other.

13. The apparatus according to claim 7 wherein an elastic member provided on inner surfaces of the first support elements is harder than an elastic member provided on inner surfaces of the second support elements.

14. The apparatus according to claim 1 further comprising foamed materials provided for a junction between the left second support unit and the first support unit, and for a junction between the right second support unit and the first support unit.

15. An anodizing apparatus for causing an anodizing reaction on substrates immersed in an electrolyte solution, comprising:

a storage tank for storing the electrolyte solution;

a substrate holder mounted in the storage tank, and including a first support unit having a plurality of first support elements arranged in a direction of arrangement of the substrates for contacting and supporting, in a liquid-tight condition, only lower portions of circumferential surfaces of the substrates, and a second support unit attachable to and detachable from the first support unit and having a plurality of second support elements arranged in the direction of arrangement of the substrates for contacting and supporting, in a liquid-tight condition, remaining portions of the circumferential surfaces of the substrates other than the lower portions supported by the first support elements;

a drive mechanism for separating the first support unit and the second support unit when placing the plurality of substrates in the substrate holder and when unloading the plurality of substrates from the substrate holder, and for connecting the first support unit and the second support unit after the plurality of substrates are placed in the substrate holder;

wherein the second support unit includes a left second support unit having left second support elements as the second support elements for supporting left sides of the remaining portions of the circumferential surfaces of the substrates, and a right second support unit having right second support elements as the second support elements for supporting right sides of the remaining portions of the circumferential surfaces of the substrates.

16. The apparatus according to claim 15 wherein the left second support unit and the right second support unit have fulcrums, respectively, and have the first support unit in between, and are rockable away from each other when separating from the first support unit.

17. The apparatus according to claim 16 wherein the fulcrums are located in positions at a bottom of the storage tank.

18. The apparatus according to claim 1 wherein said first and second support units are constructed for contacting and supporting said circumferential surfaces of said substrates, in said liquid-tight condition, wherein said circumferential surfaces are circular.

19. The apparatus according to claim 1 wherein said first and second support units are constructed for contacting and supporting said circumferential surfaces of said substrates, in said liquid-tight condition, wherein said circumferential surfaces are square.

* * * * *